US010596578B2

(12) United States Patent
Kusaka et al.

(10) Patent No.: US 10,596,578 B2
(45) Date of Patent: Mar. 24, 2020

(54) PRODUCTION METHOD FOR LOW-SULFUR IRON ORE

(71) Applicant: KOBE STEEL, LTD., Kobe-shi (JP)

(72) Inventors: Eishi Kusaka, Kyoto (JP); Katsuyuki Iijima, Hyogo (JP); Takayasu Fujiura, Hyogo (JP)

(73) Assignee: KOBE STEEL, LTD., Kobe-shi (JP)

( * ) Notice: Subject to any disclaimer, the term of this patent is extended or adjusted under 35 U.S.C. 154(b) by 1157 days.

(21) Appl. No.: 14/893,420

(22) PCT Filed: Jun. 23, 2014

(86) PCT No.: PCT/JP2014/066581
§ 371 (c)(1),
(2) Date: Nov. 23, 2015

(87) PCT Pub. No.: WO2014/208504
PCT Pub. Date: Dec. 31, 2014

(65) Prior Publication Data

US 2016/0107170 A1 Apr. 21, 2016

(30) Foreign Application Priority Data

Jun. 27, 2013 (JP) ..... 2013-134905

(51) Int. Cl.
*B03D 1/02* (2006.01)
*B03D 1/012* (2006.01)
*B03D 1/01* (2006.01)

(52) U.S. Cl.
CPC ..... *B03D 1/012* (2013.01); *B03D 1/01* (2013.01); *B03D 1/02* (2013.01); *B03D 2201/02* (2013.01); *B03D 2203/02* (2013.01)

(58) Field of Classification Search
CPC . B03D 1/02; B03D 1/012; B03D 1/01; B03D 2203/02; B03D 2201/02
(Continued)

(56) References Cited

U.S. PATENT DOCUMENTS 2,629,494 A 2/1953 Brown
4,908,125 A * 3/1990 Mackenzie ..... B03D 1/01 209/166
(Continued)

FOREIGN PATENT DOCUMENTS

CN 101254484 A * 9/2008
CN 102553717 A 7/2012
(Continued)

OTHER PUBLICATIONS

Machine translation of CN 101254484 (no date).*
(Continued)

*Primary Examiner* — Thomas M Lithgow
(74) *Attorney, Agent, or Firm* — Oblon, McClelland, Maier & Neustadt, L.L.P.

(57) ABSTRACT

A process for producing an iron ore having a sulfur content reduced to 0.08% or less, which includes a step of subjecting an iron ore containing sulfur in an amount of more than 0.08% and 2% or less to a flotation. The flotation satisfies any one of the following (1) to (3): (1) a xanthate-based compound and a salt of an amine compound are used as collectors, (2) a xanthate-based compound is used as a collector and a substance which releases a sulfur ion in water is used as an activator, or (3) a xanthate-based compound and a salt of an amine compound are used as collectors and a substance which releases a sulfur ion in water is used as an activator.

16 Claims, 1 Drawing Sheet

(58) Field of Classification Search
USPC ..... 209/166
See application file for complete search history.

(56) References Cited

U.S. PATENT DOCUMENTS

| | | | | |
|---|---|---|---|---|
| 5,411,148 | A * | 5/1995 | Kelebek | B03D 1/02 209/166 |
| 2005/0232835 | A1 | 10/2005 | Tanaka et al. | |

FOREIGN PATENT DOCUMENTS

| | | | |
|---|---|---|---|
| JP | 42-12047 | B1 | 7/1967 |
| JP | 53-51125 | A | 5/1978 |
| JP | 60-150856 | A | 8/1985 |
| JP | 64-69527 | A | 3/1989 |
| WO | WO 2004/083468 | A1 | 9/2004 |

OTHER PUBLICATIONS

International Search Report dated Sep. 9, 2014 in PCT/JP2014/066581 (with English language translation).
Written Opinion dated Sep. 9, 2014 in PCT/JP2014/066581 (with English language translation).
Taneomi Harada, "Effects of Oxidation of Pyrrhotite, Pyrite and Marcasite on Their Flotation Properties" Journal of MMIJ, vol. 80, No. 914, 1964, 30 pages (with English language translation and English Abstract).
Toru Ishihara, et al., "Flotation of Pyrrhotite using Cationic Collector" Journal of MMIJ, vol. 75, No. 850, 1959, 19 pages (with English language translation and English Abstract).
Ting-Sheng Qiu, et al. "Application Situation of Sodium Sulfide in the Flotation", Nonferrous Metals Science and Engineering, vol. 3, No. 6, 2012, pp. 39-43 (with English Abstract).
Extended European Search Report dated Oct. 10, 2017 in Patent Application No. 14818216.5.
B. Arvidson et al., "Flotation of Pyrrhotite to Produce Magnetite Concentrates with a Sulphur Level Below 0.05% w/w", Minerals Engineering, vol. 50, XP028704527, Jun. 28, 2013, pp. 4-12.
Armando Correa De Araujo et al: "Flotation of Pyrrhotite from Magnetite Ores—A Kazakh Case Study 1", 6th International Congress on the Science and Technology of Ironmaking—ICSTI, XP055405831, Oct. 18, 2012, pp. 1928-1945 and cover page.
Partial Supplementary European Search Report dated Apr. 5, 2017 in Patent Application No. 14818216.5.
N. O. Lotter, et al., "The formulation and use of mixed collectors in sulphide floatation" Minerals Engineering, vol. 23, No. 11-13, XP027404247, 2010, pp. 945-951.
D.J. Bradshaw, et al., "Synergistic interactions between reagents in sulphide flotation" The Journal of the South African Institute of Mining and Metallurgy, XP055255135, 1998, pp. 189-194.
M. Benzaazoua, et al., "Environmental desulphurization of four Canadian mine tailings using froth flotation" International Journal of Mineral Processing., vol. 60, No. 1, XP055359131, 2000, pp. 57-74.
M.H. Buckenham, et al., "Molecular Associations in Floatation" Transactions of Society of Mining Engineers, vol. 226, XP009172372, Mar. 1963, pp. 1-6.

* cited by examiner

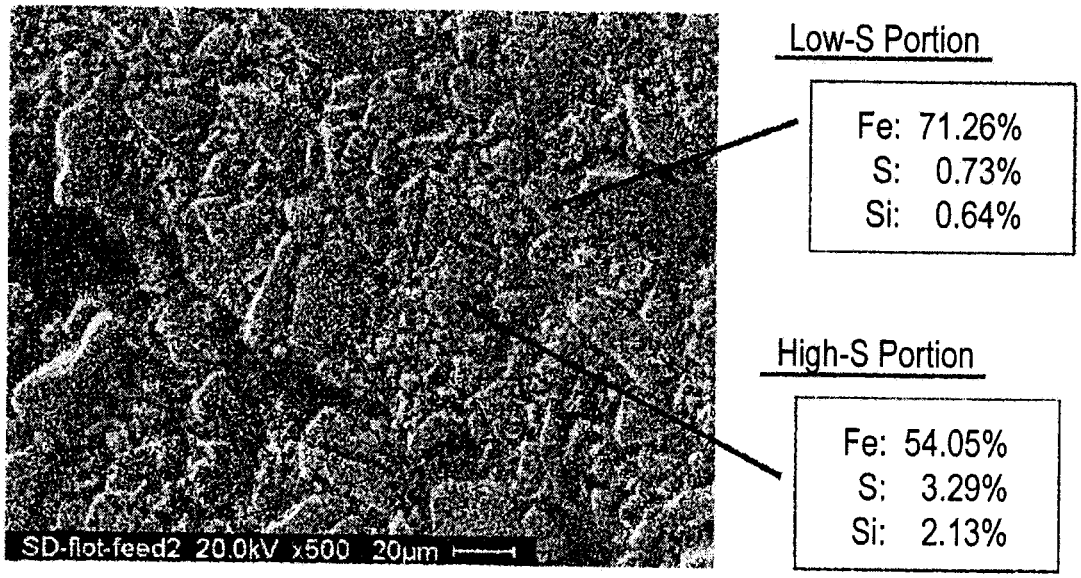
SD-flot-feed2 20.0kV x500 20μm
Low-S Portion
Fe: 71.26%
S: 0.73%
Si: 0.64%
High-S Portion
Fe: 54.05%
S: 3.29%
Si: 2.13%

PRODUCTION METHOD FOR LOW-SULFUR IRON ORE

TECHNICAL FIELD

The present invention relates to a process for producing an iron ore having a sulfur content reduced to 0.08% or less by subjecting a sulfur-containing iron ore to flotation.

BACKGROUND ART

Iron ores are present abundantly, and high-quality iron ores containing small amounts of impurities including sulfur have been used in large quantities. However, the demand of iron ores has increased and it is becoming difficult to procure high-quality iron ores. Therefore, it is necessary to purify and then use low-quality iron ores containing large amounts of impurities including sulfur.

Known as a technique for diminishing the impurities contained in low-quality iron ores is flotation. Flotation is a process for beneficiation in which air bubbles are supplied to an aqueous suspension containing fine iron ore particles, and particles of a specific kind only are caused to adhere to the air bubbles and selectively float and are thus separated.

When the sulfur, among the impurities contained in low-quality iron ores, is selectively removed, a xanthate is generally used as a collector. For example, Non-Patent Document 1 discloses a technique in which pyrrhotite (substance represented by FeSx) containing 36.73% sulfur is subjected to flotation using a xanthate as a collector. Non-Patent Document 2 discloses a technique in which pyrrhotite containing sulfur in the range of 39.0-42.5% is subjected to flotation using a xanthate or RADA (Rosin Amine D Acetate) as a collector. Furthermore, Patent Document 1 discloses a flotation technique in which a xanthate that has been reacted with a carbohydrate is used in combination with an amine and the pH of the aqueous solution is adjusted to about 8, thereby heightening the iron concentration of taconite, which is a poor ore, from about 30% to about 60%.

PRIOR ART DOCUMENTS

Patent Document

Patent Document 1: U.S. Pat. No. 2,629,494

Non-Patent Documents

Non-Patent Document 1: HARADA, Taneomi, "Effects of Oxidation of Pyrrhotite, Pyrite and Marcasite on their Flotation Properties", *Journal of MMIJ*, Vol. 80, No. 914 (August, 1964), pp. 669-674

Non-Patent Document 2: ISHIHARA, Toru, "Flotation of Pyrrhotite using Cationic Collector", *Journal of MMIJ*, Vol. 75, No. 850 (April, 1959), pp. 213-216

SUMMARY OF THE INVENTION

Problem that the Invention is to Solve

Among low-quality iron ores, there are ones which contain sulfur in a small amount in a range of more than 0.08% and 2% or less. It is thought that if a technique capable of reducing the small amount of sulfur contained in such low-quality iron ores to 0.08% or less can be offered, this is useful as a substitution technique for iron ores originally having a sulfur content of 0.08% or less.

In Non-Patent Document 1 and Non-Patent Document 2, as described above, techniques are investigated in which a pyrrhotite containing sulfur in a large amount in the range of 36.73 to 42.5% is subjected to flotation. However, these include no investigation concerning, for example, producing an iron ore having a sulfur content reduced to 0.08% or less by subjecting an iron ore containing sulfur in a small amount in a range of more than 0.08% and 2% or less to flotation. In Non-Patent Document 1 and Non-Patent Document 2, use of a collector in a large amount is necessary for reducing the sulfur content to 0.08% or less, resulting in an increase in cost. Meanwhile, Patent Document 1 does not disclose the component composition of the iron ore, and the content of sulfur in the iron ore is also unknown. This document describes nothing but a method for iron ore purification in which a xanthate that has been reacted with a carbohydrate is used in combination with an amine.

The present invention has been achieved in view of the circumstances described above. An object thereof is to provide a process capable of inexpensively producing an iron ore having a sulfur content reduced to 0.08% or less, by subjecting an iron ore containing sulfur in a range of more than 0.08% and 2% or less (i.e., an iron ore including pyrrhotite and containing sulfur in a range of more than 0.08% and 2% or less) to flotation.

Means for Solving the Problem

The process for producing a low-sulfur-content iron ore according to the present invention, which has succeeded in overcoming the problem described above, is a process for producing an iron ore having a sulfur content reduced to 0.08% or less, including subjecting an iron ore containing sulfur in an amount of more than 0.08% and 2% or less to a flotation, in which during the flotation, (1) a xanthate-based compound and a salt of an amine compound are used as collectors, (2) a xanthate-based compound is used as a collector and a substance which releases a sulfur ion in water is used as an activator, or (3) a xanthate-based compound and a salt of an amine compound are used as collectors and a substance which releases a sulfur ion in water is used as an activator.

The xanthate-based compound and the salt of an amine compound may be simultaneously added. As the substance which releases a sulfur ion in water, use can be made, for example, of at least one member selected from the group consisting of sodium sulfide, sodium hydrosulfide and sodium thiosulfate. It is preferable that the flotation should be conducted at a pH in a range of 4 or more and less than 7.

Effects of the Invention

According to the present invention, when an iron ore containing sulfur in a small amount in a range of more than 0.08% and 2% or less is subjected to flotation, the sulfur is efficiently removed since, in the flotation, a xanthate-based compound is used as a collector and further, a salt of an amine compound is used as a collector and/or a substance which releases a sulfur ion in water is used as an activator. As a result, an iron ore having a sulfur content reduced to 0.08% or less can be produced at a low cost. According to the present invention, the amount of the xanthate-based compound to be used can be reduced as compared with conventional ones and, hence, the burden of the treatment of waste liquids resulting from the flotation can be lessened.

BRIEF DESCRIPTION OF THE DRAWING

FIG. 1 is a photograph of a section of an iron ore, as a drawing substitute.

MODES FOR CARRYING OUT THE INVENTION

The present inventors had diligently made investigations about a method for producing an iron ore having a sulfur (S) content reduced to 0.08% or less, by subjecting an iron ore containing sulfur in a range of more than 0.08% and 2% or less (i.e., an iron ore including pyrrhotite and containing sulfur in a range of more than 0.08% and 2% or less) to flotation. As a result, they discovered that in cases when a salt of an amine compound is used as a collector and/or a substance which releases a sulfur ion in water is used as an activator, in combination with a xanthate-based compound which has conventionally been used as a collector, then the sulfur removal rate is further increased and the amount of sulfur contained in the iron ore can be reduced to 0.08% or less. The present invention has been thus completed. In the present description, the term "amount of sulfur contained in an iron ore (sulfur content of an iron ore)" means the proportion in percentage (%) of the sulfur contained in a sulfur-containing iron ore, based on the whole iron ore (100%). The percentage (%) specifically is percentage on a mass basis (% by mass). In the present description, percentage on a mass basis (% by mass) is the same as percentage on a weight basis (% by weight).

Namely, (1) the present inventors discovered, from examinations of sections of iron ores, that Fe and Si are apt to coexist in areas where S is contained in a large amount. They hence made various investigations and, as a result, have discovered that: in cases where a xanthate-based compound and a salt of an amine compound are used as collectors during flotation, the FeSx (pyrrhotite) contained in the iron ore can be separated and removed by the action of the xanthate-based compound and the $SiO_2$ contained in the iron ore can be separated and removed by the action of the salt of an amine compound; and by subjecting the $SiO_2$ to the flotation, the S coexisting with the $SiO_2$ can be removed and thus the amount of sulfur contained in an iron ore can be reduced to 0.08% or less.

(2) It has also been discovered that: pyrrhotite is susceptible to oxidation and becomes, upon oxidation, difficult to remove by flotation with a collector; and in cases when a xanthate-based compound is used as a collector and a substance which releases a sulfur ion in water is used as an activator during flotation, then the pyrrhotite contained in the iron ore can be prevented by the action of the activator from oxidizing and, hence, the pyrrhotite can be reliably subjected to the flotation and thus the amount of sulfur contained in an iron ore can be reduced to 0.08% or less.

(3) Furthermore, it has been discovered that in cases when a xanthate-based compound and a salt of an amine compound are used as collectors and a substance which releases a sulfur ion in water is further used as an activator, then the amount of sulfur contained in an iron ore can be further reduced by a synergistic effect of (1) and (2) above.

Detailed explanations are given below on (1) to (3).

[With Respect to (1)]

The present inventors first made examinations with an electron microscope (SEM/EDX) in order to ascertain how sulfur was generally present in an iron ore, prior to the purification by flotation of an iron ore containing a small amount of sulfur as an impurity. The iron ore was embedded in a resin, and a section thereof was polished and photographed. The photograph is shown in FIG. 1 as a drawing substitute.

As FIG. 1 shows, it was revealed that in an area where S was contained in an amount of 0.73% (low-S portion), Fe was contained in an amount of 71.26% but Si was as low as 0.64%. In contrast, it was revealed that in an area where S was contained in an amount of 3.29% (high-S portion), Fe was contained in an amount of 54.05% and Si was contained in an amount of 2.13%. These results are thought to suggest that $SiO_2$ mingles in areas where S is present as FeS (pyrite) or FeSx (pyrrhotite).

In the present invention, a xanthate-based compound which is effective in flotation for removing FeS and FeSx and an amine compound salt which is effective in flotation for removing $SiO_2$ are used in combination. By using a salt of an amine compound, in combination with a xanthate-based compound, the $SiO_2$ can be removed by flotation. Here, the S components coexisting with the $SiO_2$ are also removed by the flotation and thereby the amount of S contained in an iron ore can be reduced to 0.08% or less.

In this description, the term "xanthate-based compound" contains the meanings of not only a xanthate but also a dithiocarbamic acid salt. The term xanthate means a xanthic acid salt having the chemical structure —OC(═S)—S—. Examples of the xanthate include compounds represented by the general formula R—OC(═S)—S-$M^+$ (where R represents an alkyl group having 1 to 20 carbon atoms, and M represents an alkali metal, such as Na or K, $NH_4$, etc.).

As the xanthate, a known one can be used. For example, use can be made of potassium amyl xanthate, potassium ethyl xanthate, sodium ethyl xanthate, sodium isopropyl xanthate, potassium isobutyl xanthate, sodium isobutyl xanthate, or the like. In regard to these xanthates, two or more kinds selected at will may be used.

As the dithiocarbamic acid salt, commercial products (available, for example, from Tokyo Chemical Industry Co., Ltd.) can be used.

It is preferable that the xanthate-based compound should be added, for the flotation, in an amount of 10 to 250 g per ton of the iron ore. The added amount of the xanthate-based compound is more preferably 50 to 225 g per ton of the iron ore. In case where the added amount of xanthate-based compound is less than 10 g per ton of the iron ore, the amount of the xanthate-based compound is too small to sufficiently react with the FeSx (pyrrhotite) contained in the iron ore, resulting in a possibility that the amount of sulfur contained in an iron ore cannot be sufficiently reduced. Meanwhile, in case where the xanthate-based compound is added in an amount exceeding 250 g per ton of the iron ore, there is the possibility of resulting in too high a cost.

As the salt of an amine compound, use can be made, for example, of an acetic acid salt of an amine compound, a hydrochloric acid salt of an amine compound, a sulfuric acid salt of an amine compound, a nitric acid salt of an amine compound, or the like. In particular, an acetic acid salt of an amine compound can be suitably used.

As the amine compound, an amine having an alkyl group can be used. The number of carbon atoms of the alkyl group is not particularly limited. For example, the number of carbon atoms thereof may be 6 to 18, and more preferably the number of carbon atoms is 8 to 18. When the number of carbon atoms of the alkyl group is less than 6, there are cases where the adhesion to the bubbles becomes insufficient.

Meanwhile, when the number of carbon atoms of the alkyl group exceeds 18, there are cases where the solubility in water is impaired. The amine may be any of a primary amine, secondary amine, tertiary amine, and quaternary amine. The salt of an amine compound is preferably a salt of dodecylamine and more preferably dodecylamine acetate.

It is preferable that the salt of an amine compound should be added, for the flotation, in an amount of 1 to 100 g per ton of the iron ore. The added amount of the salt of an amine compound is more preferably 5 to 20 g per ton of the iron ore. In case where the added amount of the salt of an amine compound is less than 1 g per ton of the iron ore, the amount of the salt of an amine compound is too small to sufficiently separate and remove the $SiO_2$ contained in the iron ore, resulting in a possibility that the amount of sulfur contained in an iron ore cannot be sufficiently reduced. Meanwhile, in case where the salt of an amine compound is added in an amount exceeding 100 g per ton of the iron ore, the amount of the amine compound is too large and there is a possibility that, on the contrary, the amount of sulfur contained in an iron ore cannot be sufficiently reduced in the flotation.

For the flotation, the xanthate-based compound and the salt of an amine compound may be added separately or added simultaneously. They are, however, preferably added simultaneously.

Next, an explanation is given on the process for producing an iron ore having a sulfur content reduced to 0.08% or less by subjecting an iron ore containing sulfur in an amount of more than 0.08% and 2% or less to flotation using a xanthate-based compound and a salt of an amine compound as collectors.

First, the iron ore containing sulfur in an amount of more than 0.08% and 2% or less is introduced into a vessel containing water. It is preferable that the iron ore should have been ground beforehand to an average particle diameter of about 10 to 250 μm.

With respect to the concentration of the iron ore (usually called pulp concentration, which is calculated by using the formula: pulp concentration (%)=mass of iron ore/mass of water×100), lower values result in an increase in the ability to separate pyrrhotite but in a decrease in the treated amount per unit time period. It is therefore preferred to regulate the pulp concentration to 10% or higher. Although higher pulp concentrations result in an increase in the treated amount per unit time period, excessively heightened iron ore concentrations result in an decrease in the ability to separate pyrrhotite. Consequently, the pulp concentration is regulated to preferably 70% or less, more preferably 60% or less.

The pH of the aqueous solution in the vessel into which the iron ore has been introduced is an important factor which determines the charge of the iron ore surface. In the present invention, it is preferred to adjust the aqueous solution to acidic, in particular, the pH of the aqueous solution to 4 or more and less than 7. It is more preferred to adjust the pH of the aqueous solution to about 4.5 to 5.5. For regulating the pH of the aqueous solution, use may be made of a pH regulator such as an aqueous NaOH solution or an aqueous sulfuric acid solution.

When the pH of the aqueous solution is adjusted, it is thought to require a certain time period for the charge of the iron ore surface to change. Therefore, after initiation of the addition of a pH regulator, a holding for, for example, 10 seconds to 5 minutes is recommended.

After the pH of the aqueous solution has been regulated, collectors and a frother are added to conduct flotation.

As the collectors, use is made of a xanthate-based compound and a salt of an amine compound. Although the xanthate-based compound and the salt of an amine compound may be added separately or added simultaneously, it is preferred to be added simultaneously. The xanthate-based compound and the salt of an amine compound each may be added at a time in a given amount, or may be added in multiple installments. It is, however, preferred to be added in multiple installments.

After the two kinds of collectors have been added, a frother may be added. The frother is a substance which heightens the stability of bubbles which generate during flotation, and a known one may be used. For example, use can be made of methyl isobutyl carbinol, methyl isobutyl ketone, ethanol, pine oil, "W55 (trade name)" by Huntsman Corp., or the like.

The steps described above, i.e., the step of introducing an iron ore into water, the step of regulating the pH of the aqueous solution, the step of adding collectors, and the step of adding a frother, are generally inclusively called conditioning.

After the addition of the collectors and frother, air bubbles are then supplied to the inside of the vessel to initiate flotation.

The supply period of the bubbles is not particularly limited, and it may be a period until an S-containing portion of iron ore is floated and removed and the iron ore remaining in the water comes to have an S content of 0.08% or less.

After initiation of the flotation, the pyrrhotite which has floated on the water may be recovered and separated by using a scraper.

The collectors and the frother each may be added in multiple installments in the course of the flotation.

Next, the introduction of bubbles is terminated after the flotation, and the sample remaining in the vessel is recovered and dried. Thus, an iron ore having a sulfur content reduced to 0.08% or less is obtained.

[With Respect to (2)]

The surface of pyrrhotite (FeSx) readily oxidizes upon contact with air. In the surface oxidation, since the reaction below occurs and the oxidized pyrite cannot be distinguished from iron oxide ($Fe_3O_4$), it is difficult to be separated by flotation using a collector.

$$FeSx+O_2 \rightarrow Fe_3O_4+SO_2$$

Consequently, in the present invention, the iron oxide formed by the oxidation is sulfurized (that is, a reaction which proceeds in the direction opposite to the arrow of the reaction shown above is caused to occur), in order to remove the thus-yielded pyrrhotite by flotation, a xanthate-based compound is used as a collector and a substance which releases a sulfur ion in water is used as an activator.

As the xanthate-based compound, a known one can be used. The ones exemplified above in the section of (1) can be used.

As the substance which releases a sulfur ion in water, use can be made, for example, of at least one member selected from the group consisting of sodium sulfide ($Na_2S$), sodium hydrosulfide (NaSH), and sodium thiosulfate ($Na_2S_2O_3$). It is preferred to use sodium sulfide ($Na_2S$) or sodium hydrosulfide (NaSH).

It is preferable that the substance which releases a sulfur ion in water should be added for the flotation in an amount of 10 to 1,000 g per ton of the iron ore. More preferably, it is 50 to 250 g per ton of the iron ore. In case where the substance which releases a sulfur ion in water is excessively added, this reacts not only with the iron oxide ($Fe_3O_4$) yielded by the oxidation of the pyrrhotite but also with the iron oxide originally present as $Fe_3O_4$ in the iron ore, resulting in a decrease in the yield of an iron ore having a sulfur content reduced to 0.08% or less.

It has been ascertained that in the case where $Na_2S$ or NaSH is used as the substance which releases a sulfur ion in water, the addition thereof in an amount up to 225 g per ton of the iron ore is effective. Meanwhile, in the case where NaSH is used as the substance which releases a sulfur ion in water, it also has been ascertained that the addition thereof even in an amount of 50 g per ton of the iron ore contributes to a reduction in S content.

Next, an explanation is given on the process for producing an iron ore having a sulfur content reduced to 0.08% or less by subjecting an iron ore containing sulfur in an amount of more than 0.08% and 2% or less to flotation using a xanthate-based compound as a collector and using a substance which releases a sulfur ion in water as an activator. Regarding redundant portions as in (1) above, explanations are omitted.

The step of adding an iron ore to water is the same as in (1) above.

Next, a substance which releases a sulfur ion in water is added as an activator to the aqueous solution in the vessel into which the iron ore has been introduced. With respect to the addition of the substance which releases a sulfur ion in water, the reaction on the iron ore surface requires a certain time period. Therefore, after initiation of the addition of the substance which releases a sulfur ion in water, a holding for, for example, 10 seconds to 5 minutes is recommended.

After the addition of the activator, a pH regulator is added to regulate the pH of the aqueous solution in the same manner as in (1) above.

After the pH of the aqueous solution has been regulated, a collector and a frother are added to conduct flotation. As the collector, a xanthate-based compound is used, and the ones exemplified above in the section of (1) can be used. As the frother, a known one may be used, and the ones exemplified above in the section of (1) can be used.

After the addition of the collector and the frother, the flotation is conducted while air bubbles being supplied to the inside of the vessel and the sample remaining in the vessel is recovered and dried, in the same manners as in (1) above. The iron ore thus obtained has a sulfur content reduced to 0.08% or less.

[With Respect to (3)]

In (3) above, the collectors (i.e., a xanthate-based compound and a salt of an amine compound) and the activator (i.e., a substance which releases a sulfur ion in water) are used in combination. By using a xanthate-based compound, a salt of an amine compound and a substance which releases a sulfur ion in water, the removal rate of sulfur can be heightened and, hence, the amount of sulfur contained in an iron ore can be further reduced.

Next, an explanation is given on the process for producing an iron ore having a sulfur content reduced to 0.08% or less by subjecting an iron ore containing sulfur in an amount of more than 0.08% and 2% or less to flotation by using a xanthate-based compound and a salt of an amine compound as collectors and using a substance which releases a sulfur ion in water as an activator. Regarding redundant portions as in (1) or (2) above, explanations are omitted.

An iron ore is added to water in the same manner as in (1) above. Thereafter, a substance which releases a sulfur ion in water is added as an activator to the aqueous solution in the vessel into which the iron ore has been introduced, in the same manner as in (2) above.

After the addition of the activator, a pH regulator is added to regulate the pH of the aqueous solution in the same manner as in (1) above.

After the pH of the aqueous solution has been regulated, collectors and a frother are added to conduct flotation. As the collectors, a xanthate-based compound and a salt of an amine compound are used as in (1) above. As the frother, a known one may be used, and the ones exemplified above in the section of (1) can be used.

After the addition of the collectors and the frother, the flotation is conducted while air bubbles being supplied to the inside of the vessel and the sample remaining in the vessel is recovered and dried, in the same manners as in (1) above. The iron ore thus obtained has a sulfur content reduced to 0.08% or less.

The kinds of flotation machines to which those agents are applicable are not particularly limited, and use can be made of an Agitair-type flotation machine (available from CMT Co., Ltd., etc.), a mechanical flotation machine (Kyoto-University type flotation machine), a column type flotation machine, or the like.

The present invention will be explained below in more detail by reference to Examples. However, the present invention should not at all be construed as being limited by the following Examples, and it is a matter of course that it can be suitably modified to be performed within the scope adaptable to the gist described hereinabove and hereinafter. All these modifications are included in the technical range of the present invention.

EXAMPLES

Experimental Example 1

In Experimental Example 1, an iron ore was subjected to flotation using a xanthate-based compound and a salt of an amine compound as collectors and using the Kyoto-University type flotation machine. The specific explanations will be made below.

First, a frozen iron ore containing sulfur as an impurity (pyrrhotite-containing iron ore) was prepared in an amount of 180 g. The reason for the use of a frozen one is in order to minimize the surface oxidation of the pyrrhotite. The pyrrhotite-containing iron ore prepared had an average particle diameter of about 30 μm (50% particle diameter).

The pyrrhotite-containing iron ore prepared was thawed, and the amount of the water contained in the pyrrhotite-containing iron ore was determined. As a result, it was found to be about 20 g. It was hence found that the frozen pyrrhotite-containing iron ore contained pyrrhotite in an amount of 160 g in terms of dry mass.

The component composition of the pyrrhotite-containing iron ore is shown in Table 1 below. In Table 1, T.Fe means total Fe amount and T.S means total S amount. As apparent from Table 1, it can be seen that the pyrrhotite-containing iron ore prepared contained 0.29% sulfur.

TABLE 1

| Iron ore Component composition (% by mass) | | | | |
|---|---|---|---|---|
| T. Fe | $SiO_2$ | $TiO_2$ | $Al_2O_3$ | T. S |
| 69.9 | 0.97 | 0.38 | 1.31 | 0.29 |

Next, the frozen pyrrhotite-containing iron ore prepared was added to 360 g of water, followed by stirring. After the stirring, the pH of the aqueous solution was measured and the pH was found to be about 6.

Sulfuric acid having a concentration regulated to 0.1 mol/L was subsequently added to adjust the pH of the aqueous solution to 5. The pH adjustment was conducted by adding the sulfuric acid over a period of 3 minutes.

Next, an aqueous solution containing a xanthate-based compound was prepared and added to the aqueous solution having the adjusted pH. Specifically, potassium amyl xanthate manufactured by Tokyo Chemical Industry Co., Ltd. was used as the xanthate-based compound. The potassium amyl xanthate was added, in an amount of 180 mg, to 50 mL of water to prepare an aqueous potassium amyl xanthate solution. A 2-mL portion of this aqueous solution was taken and added to the aqueous solution having the adjusted pH, followed by holding for 1 minute. The addition of 2 mL of the aqueous potassium amyl xanthate solution means that the mass of the potassium amyl xanthate used is calculated at about 45 g per ton of the pyrrhotite-containing iron ore.

An aqueous solution containing a salt of an amine compound was then prepared and further added to the aqueous solution to which the aqueous potassium amyl xanthate solution had been added. Specifically, dodecylamine acetate manufactured by Tokyo Chemical Industry Co., Ltd. was used as the salt of an amine compound. The dodecylamine acetate was added, in an amount of 16 mg, to 50 mL of water to prepare an aqueous dodecylamine acetate solution. A 2-mL portion of this aqueous solution was taken and added to the aqueous solution to which the aqueous potassium amyl xanthate solution had been added. The mass of the dodecylamine acetate used is calculated at about 4 g per ton of the pyrrhotite-containing iron ore.

After the addition of the aqueous dodecylamine acetate solution, 0.008 g (two drops from the tip of an injection needle) of a frother was added, followed by holding for 1 minute. As the frother, "W55 (trade name)", manufactured by Huntsman Corp., was used. After the holding, the aqueous solution in the vessel was stirred and, simultaneously therewith, air was supplied to conduct flotation. As a result, upon initiation of the flotation, bubbles including pyrrhotite rose to the upper surface within the vessel. These bubbles were hence recovered with a scraper.

At 6 minutes after, 12 minutes after, 18 minutes after, and 24 minutes after initiation of the flotation (namely, at intervals of 6 minutes), 2 mL of the aqueous potassium amyl xanthate solution and 2 mL of the aqueous dodecylamine acetate solution were added and the recovery of bubbles was continued further. Thus, the potassium amyl xanthate which had been added amounted to about 225 g per ton of the pyrrhotite-containing iron ore, while the dodecylamine acetate which had been added amounted to about 20 g per ton of the pyrrhotite-containing iron ore.

After 30 minutes had passed since initiation of the flotation, the stirring and the supply of air were stopped. After the stopping, the sample remaining in the vessel was recovered, dried, and then subjected to chemical analysis to determine the amount of sulfur contained in the sample. As a result, the amount of sulfur was found to be 0.04%.

These results showed that the amount of sulfur contained in the pyrrhotite-containing iron ore can be reduced from 0.29% to 0.04% by conducting the flotation using a xanthate-based compound and a salt of an amine compound in combination as collectors.

Experimental Example 2

In Experimental Example 2, flotation was conducted using a xanthate-based compound as a collector and using a substance which releases a sulfur ion in water as an activator. The specific explanations will be made below.

The same frozen pyrrhotite-containing iron ore as that used in Experimental Example 1 was prepared in an amount of 180 g. This was added to 360 g of water, followed by stirring.

Next, an aqueous solution containing NaSH, as a substance which releases a sulfur ion in water (activator), was prepared and added to the aqueous solution which had been stirred. Specifically, NaSH manufactured by Nacalai Tesque, Inc. was used as the substance which releases a sulfur ion in water (activator). The NaSH was added, in an amount of 180 mg, to 50 mL of water to prepare an aqueous NaSH solution, and a 2-mL portion of this aqueous solution was taken and added to the aqueous solution which had been stirred, followed by holding for 2.5 minutes.

Sulfuric acid was then added to adjust the pH of the aqueous solution to 5 in the same manner as in Experimental Example 1. The pH adjustment was conducted by adding the sulfuric acid over a period of 5 minutes.

Next, in the same manner as in Experimental Example 1, an aqueous potassium amyl xanthate solution was prepared and added to the aqueous solution having the adjusted pH. The addition of the aqueous potassium amyl xanthate solution was followed by holding for 1 minute.

After the addition of the aqueous potassium amyl xanthate solution, a frother was added, followed by holding for 1 minute, in the same manner as in Experimental Example 1. After the holding, flotation was conducted in the same manner as in Experimental Example 1.

At 6 minutes after, 12 minutes after, 18 minutes after, and 24 minutes after initiation of the flotation (namely, at intervals of 6 minutes), 2 mL of the aqueous potassium amyl xanthate solution was added and the recovery of bubbles was continued further. Thus, the potassium amyl xanthate which had been added amounted to about 225 g per ton of the pyrrhotite-containing iron ore.

After 30 minutes had passed since initiation of the flotation, the stirring and the supply of air were stopped. After the stopping, the sample remaining in the vessel was recovered, dried, and then subjected to chemical analysis to determine the amount of sulfur contained in the sample. As a result, the amount of sulfur was found to be 0.06%.

These results showed that the amount of sulfur contained in the pyrrhotite-containing iron ore can be reduced from 0.29% to 0.06% by conducting the flotation using a xanthate-based compound as a collector and using a substance which releases a sulfur ion in water, such as NaSH, as an activator.

Experimental Example 3

In Experimental Example 3, flotation was conducted under the same conditions as in Experimental Example 2, except that $Na_2S$ was used instead of using the NaSH as a substance which releases a sulfur ion in water (activator). Namely, in Experimental Example 3, $Na_2S$ manufactured by Nacalai Tesque, Inc. was prepared as a substance which releases a sulfur ion in water (activator). This $Na_2S$ was added, in an amount of 180 mg, to 50 mL of water to prepare an aqueous $Na_2S$ solution. A 2-mL portion of this aqueous solution was taken and added to the aqueous solution which had been stirred, followed by holding for 2.5 minutes, as in Experimental Example 2.

Next, in the same manner as in Experimental Example 2, sulfuric acid was added to adjust the pH of the aqueous solution to 5, an aqueous potassium amyl xanthate solution was added, and a frother was then added. Flotation was then performed.

After the flotation, the sample remaining in the vessel was recovered, dried, and then subjected to chemical analysis to determine the amount of sulfur contained in the sample. As a result, the amount of sulfur was found to be 0.06%.

These results showed that the amount of sulfur contained in the pyrrhotite-containing iron ore can be reduced from 0.29% to 0.06% by conducting the flotation using a xanthate-based compound as a collector and using a substance which releases a sulfur ion in water, such as $Na_2S$, as an activator.

Experimental Example 4

In Experimental Example 4, flotation was conducted under the same conditions as in Experimental Example 2, except that the amount of the aqueous NaSH solution used was reduced to 0.5 mL, instead of 2 mL. Namely, in Experimental Example 4, 180 mg of the NaSH was added to 50 mL of water to prepare an aqueous NaSH solution and a 0.5-mL portion of this aqueous solution was taken and, as in Experimental Example 2, added to the aqueous solution which had been stirred, followed by holding for 2.5 minutes.

Next, in the same manner as in Experimental Example 2, sulfuric acid was added to adjust the pH of the aqueous solution to 5, an aqueous potassium amyl xanthate solution was added, and a frother was then added. Flotation was then performed.

After the flotation, the sample remaining in the vessel was recovered, dried, and then subjected to chemical analysis to determine the amount of sulfur contained in the sample. As a result, the amount of sulfur was found to be 0.07%.

A comparison between the results of Experimental Example 4 and those of Experimental Example 2 revealed that even when the amount of the substance which releases a sulfur ion in water which is used as an activator, such as NaSH, is reduced to 0.5 mL, the amount of sulfur contained in the pyrrhotite-containing iron ore can be lowered to 0.08% or less.

Experimental Example 5

In Experimental Example 5, flotation was conducted using a xanthate-based compound and a salt of an amine compound as collectors and using NaSH as a substance which releases a sulfur ion in water (activator). The specific explanations will be made below.

The same frozen pyrrhotite-containing iron ore as that used in Experimental Example 1 was prepared in an amount of 180 g. This was added to 360 g of water, followed by stirring.

Next, an aqueous solution containing NaSH, as a substance which releases a sulfur ion in water (activator), as in Experimental Example 2 was prepared and added to the aqueous solution which had been stirred.

Sulfuric acid was then added to adjust the pH of the aqueous solution to 5 in the same manner as in Experimental Example 1. The pH adjustment was conducted by adding the sulfuric acid over a period of 5 minutes.

Next, in the same manner as in Experimental Example 1, an aqueous potassium amyl xanthate solution was prepared and added to the aqueous solution having the adjusted pH. The addition of the aqueous potassium amyl xanthate solution was followed by holding for 1 minute.

Subsequently, in the same manner as in Experimental Example 1, an aqueous dodecylamine acetate solution was prepared and further added to the aqueous solution to which the aqueous potassium amyl xanthate solution had been added, and a frother was added to conduct flotation.

After the flotation, the sample remaining in the vessel was recovered, dried, and then subjected to chemical analysis to determine the amount of sulfur contained in the sample. As a result, the amount of sulfur was found to be 0.03%.

These results showed that by using a xanthate-based compound and a salt of an amine compound in combination and further using a substance which releases a sulfur ion in water (activator), a further reduction in sulfur content can be attained as compared with the case where a xanthate-based compound is used in combination with either a salt of an amine compound or a substance which releases a sulfur ion in water (activator), and the amount of sulfur contained in the pyrrhotite-containing iron ore can be reduced from 0.29% to 0.03%.

Experimental Example 6

In Experimental Example 6, flotation was conducted under the same conditions, except that the amount of the dodecylamine acetate used in Experimental Example 1 was increased to 45 mg. Namely, in Experimental Example 6, 45 mg of the dodecylamine acetate was added to 50 mL of water to prepare an aqueous dodecylamine acetate solution, and a 2-mL portion of this aqueous solution was taken and, as in Experimental Example 1, added to the aqueous solution to which the aqueous potassium amyl xanthate solution had been added. The mass of the dodecylamine acetate used is calculated at about 55 g per ton of the pyrrhotite-containing iron ore.

After the flotation, the sample remaining in the vessel was recovered, dried, and then subjected to chemical analysis to determine the amount of sulfur contained in the sample. As a result, the amount of sulfur was found to be 0.07%.

A comparison between the results of Experimental Example 6 and those of Experimental Example 1 revealed the following. In either case, the amount of sulfur contained in the sample finally obtained was able to be reduced to 0.08% or less. However, the reduction in the amount of sulfur to 0.08% or less was able to be attained by using the salt of an amine compound in an amount of about 20 g per ton of the pyrrhotite-containing iron ore as in Experimental Example 1, in place of using the salt of an amine compound in an amount of about 55 g per ton of the pyrrhotite-containing iron ore as in Experimental Example 6.

Experimental Example 7

In Experimental Example 7, flotation was conducted under the same conditions, except that Acetamin 24 (trade name), manufactured by Kao Corporation, was used in place of the dodecylamine acetate used in Experimental Example 1. Namely, in Experimental Example 7, Acetamin 24, manufactured by Kao Corporation, was used as a salt of an amine compound. Acetamin 24 is a mixture of amine compound salts having a hydrocarbon group with 8 to 18 carbon atoms. Acetamin 24 was added, in an amount of 32 mg, to 50 mL of water to prepare an aqueous solution of Acetamin 24, and a 1-mL portion of this aqueous solution was taken and, as in Experimental Example 1, added to the aqueous solution to which the aqueous potassium amyl xanthate solution had been added. The amount of the Acetamin 24 added is calculated at about 10 g per ton of the pyrrhotite-containing iron ore.

After the flotation, the sample remaining in the vessel was recovered, dried, and then subjected to chemical analysis to determine the amount of sulfur contained in the sample. As a result, the amount of sulfur was found to be 0.07%.

A comparison between the results of Experimental Example 7 and those of Experimental Example 1 revealed the following. In either case, the amount of sulfur contained in the sample finally obtained was able to be reduced to 0.08% or less. However, the amount of sulfur contained in the sample was able to be reduced to 0.08% or less even when a mixture of amine compound salts, such as Acetamin 24, was used in place of using a pure product of an amine compound salt as in Experimental Example 1.

Experimental Example 8

In Experimental Example 8, flotation was conducted under the same conditions as in Experimental Example 1, except that the pH of the aqueous solution was adjusted to 6.5. Namely, in Experimental Example 8, sulfuric acid having a concentration regulated to 0.1 mol/L as in Experimental Example 1 was added to adjust the pH of the aqueous solution to 6.5. Thereafter, in the same manner as in Experimental Example 1, an aqueous potassium amyl xanthate solution and an aqueous dodecylamine acetate solution were added, and a frother was then added to conduct flotation.

After the flotation, the sample remaining in the vessel was recovered, dried, and then subjected to chemical analysis to determine the amount of sulfur contained in the sample. As a result, the amount of sulfur was found to be 0.076%.

A comparison between the results of Experimental Example 8 and those of Experimental Example 1 revealed the following. In either case, the amount of sulfur contained in the sample finally obtained was able to be reduced to 0.08% or less. However, the sample had a slightly higher sulfur concentration when the pH of the aqueous solution had been slightly higher as in Experimental Example 8.

Experimental Example 9

In Experimental Example 9, flotation as in Experimental Example 1 was conducted using only the xanthate-based compound as the collector. Namely, in Experimental Example 9, sulfuric acid having a concentration regulated to 0.1 mol/L was added to adjust the pH of the aqueous solution to 5 as in Experimental Example 1. Thereafter, the aqueous potassium amyl xanthate solution was added, without the addition of an aqueous dodecylamine acetate solution, and the frother was added to conduct flotation. The aqueous potassium amyl xanthate solution was added over a period of 1 minute.

After the flotation, the sample remaining in the vessel was recovered, dried, and then subjected to chemical analysis to determine the amount of sulfur contained in the sample. As a result, the amount of sulfur was found to be 0.10%.

These results showed that in the case where only a xanthate-based compound such as potassium amyl xanthate is used as the collector in the same amount as in Experimental Example 1, the amount of sulfur contained in the pyrrhotite-containing iron ore cannot be reduced to 0.08% or less.

Experimental Example 10

In Experimental Example 10, flotation as in Experimental Example 1 was conducted using only the salt of an amine compound as the collector. Namely, in Experimental Example 10, sulfuric acid having a concentration regulated to 0.1 mol/L was added to adjust the pH of the aqueous solution to 5 as in Experimental Example 1. Thereafter, without the addition of an aqueous potassium amyl xanthate solution, the aqueous dodecylamine acetate solution was added and the frother was then added to conduct flotation. The addition of the aqueous dodecylamine acetate solution was followed by holding for 1 minute.

After the flotation, the sample remaining in the vessel was recovered, dried, and then subjected to chemical analysis to determine the amount of sulfur contained in the sample. As a result, the amount of sulfur was found to be 0.13%.

These results showed that in the case where only an amine compound salt such as dodecylamine acetate is used as the collector, the amount of sulfur contained in the pyrrhotite-containing iron ore cannot be reduced to 0.08% or less.

While the present invention has been described in detail and with reference to specific embodiments thereof, it will be apparent to one skilled in the art that various changes and modifications can be made therein without departing from the spirit and scope of the present invention.

This application is based on a Japanese patent application filed on Jun. 27, 2013 (Application No. 2013-134905), and the entire contents thereof being incorporated herein by reference.

The invention claimed is:

1. A process for producing an iron ore having a sulfur content reduced to 0.08% or less, the process comprising subjecting an iron ore containing sulfur in an amount of more than 0.08% and 2% or less to a flotation using (1) a xanthate-based compound and a salt of an amine compound as collectors, wherein the amine compound has an alkyl group having a number of carbon atoms of 6 to 18; or (2) a xanthate-based compound as a collector and a substance which releases a sulfur ion in water as an activator; or (3) a xanthate-based compound and a salt of an amine compound as collectors and a substance which releases a sulfur ion in water as an activator.

2. The process according to claim 1, wherein the flotation uses (1) or (3); and the xanthate-based compound and the salt of an amine compound are simultaneously added.

3. The process according to claim 1, wherein the flotation uses (2) or (3); and the substance which releases a sulfur ion in water is at least one member selected from the group consisting of sodium sulfide, sodium hydrosulfide, and sodium thiosulfate.

4. The process according to claim 2, wherein the flotation uses (3); and the substance which releases a sulfur ion in water is at least one member selected from the group consisting of sodium sulfide, sodium hydrosulfide, and sodium thiosulfate.

5. The process according to claim 1, wherein the flotation is conducted at a pH ranging from 4 to less than 7.

6. The process according to claim 2, wherein the flotation is conducted at a pH ranging from 4 to less than 7.

7. The process according to claim 3, wherein the flotation is conducted at a pH ranging from 4 to less than 7.

8. The process according to claim 4, wherein the flotation is conducted at a pH ranging from 4 to less than 7.

9. The process according to claim 1, wherein the flotation uses (2).

10. The process according to claim 1, wherein the flotation uses (3).

11. The process according to claim 1, wherein the xanthate-based compound in (1), (2), or (3) is added in an amount of 10 to 250 g per ton of the iron ore.

12. The process according to claim 1, wherein the flotation uses (2) or (3); and the substance which releases a sulfur ion in water is added in an amount of 10 to 1,000 g per ton of the iron ore.

13. The process according to claim 9, wherein the xanthate-based compound is added in an amount of 10 to 250 g per ton of the iron ore; and the substance which releases a sulfur ion in water is added in an amount of 10 to 1,000 g per ton of the iron ore.

14. The process according to claim 10, wherein the salt of an amine compound is at least one selected from the group consisting of an acetic acid salt of an amine compound, a hydrochloric acid salt of an amine compound, a sulfuric acid salt of an amine compound, and a nitric acid salt of an amine compound.

15. The process according to claim 10, wherein the amine compound has an alkyl group having a number of carbon atoms of 6 to 18.

16. The process according to claim 10, wherein the xanthate-based compound is added in an amount of 10 to 250 g per ton of the iron ore;

the salt of an amine compound is added in an amount of 1 to 100 g per ton of the iron ore; and the substance which releases a sulfur ion in water is added in an amount of 10 to 1,000 g per ton of the iron ore.

* * * * *